United States Patent [19]

Ferris

[11] Patent Number: 4,611,524

[45] Date of Patent: Sep. 16, 1986

[54] CAMOUFLAGED VEHICLE SUCH AS AN AIRCRAFT, SURFACE VESSEL OR THE LIKE

[76] Inventor: Carlisle K. Ferris, 50 Moraine Rd., Morris Plains, N.J. 07950

[21] Appl. No.: 642,358

[22] Filed: Aug. 20, 1984

[51] Int. Cl.[4] ..... F41H 3/00

[52] U.S. Cl. ..... 89/36.01; 244/1 R; 428/919

[58] Field of Search ..... 89/36.01; 114/15; 244/1 R; 427/256, 274; 428/919

[56] References Cited

U.S. PATENT DOCUMENTS

| | | | |
|---|---|---|---|
| 715,013 | 12/1902 | Brush et al. | 114/15 |
| 1,296,753 | 3/1919 | Brush | 428/919 |
| 1,305,296 | 6/1919 | Mackay | 114/15 |
| 2,292,848 | 8/1942 | Robson | 89/36.01 |
| 4,212,440 | 7/1980 | Ferris | 244/1 R |
| 4,302,068 | 11/1981 | Tyroler | 428/919 |

OTHER PUBLICATIONS

Dana Bell, Pri-Fly Presents A-10 Colors, Aug. 1978, pp. 6-7, 9-10.

*Primary Examiner*—Stephen C. Bentley

*Attorney, Agent, or Firm*—Shlesinger, Arkwright, Garvey & Fado

[57] ABSTRACT

A camouflage and deceptive perception distorted vehicle such as an aircraft or surface vessel or the like for combat use at least a substantial portion of which will remain undetected until the vehicle subtends an arc of substantially five minutes when used against at least one predetermined light background reflectivity in which one of the surfaces of the vehicle includes a substantial area with a predetermined reflectance matching the predetermined light background reflectance. The area includes at least three defined portions at least two of which have different reflectances so that when the reflectance of one defined portion is added to the total reflectances of the others of the three defined portions, and the result averaged, they will have a reflectance substantially that of the predetermined light background.

19 Claims, 10 Drawing Figures

FIG 1
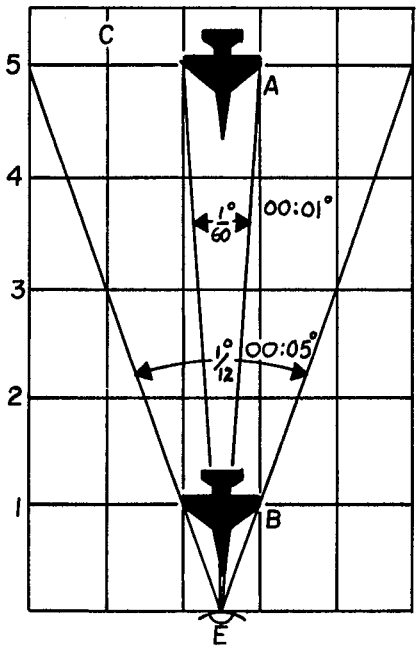
FIG 2
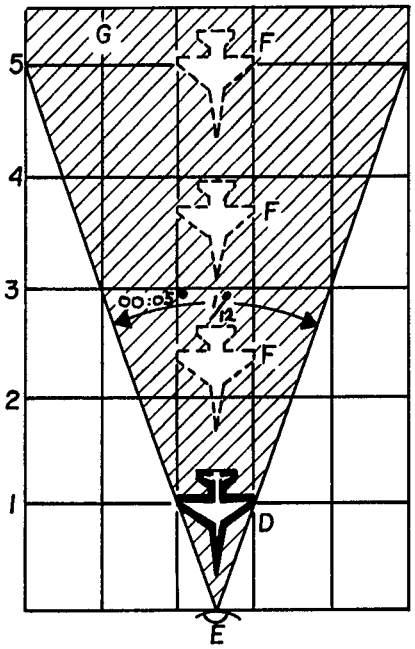
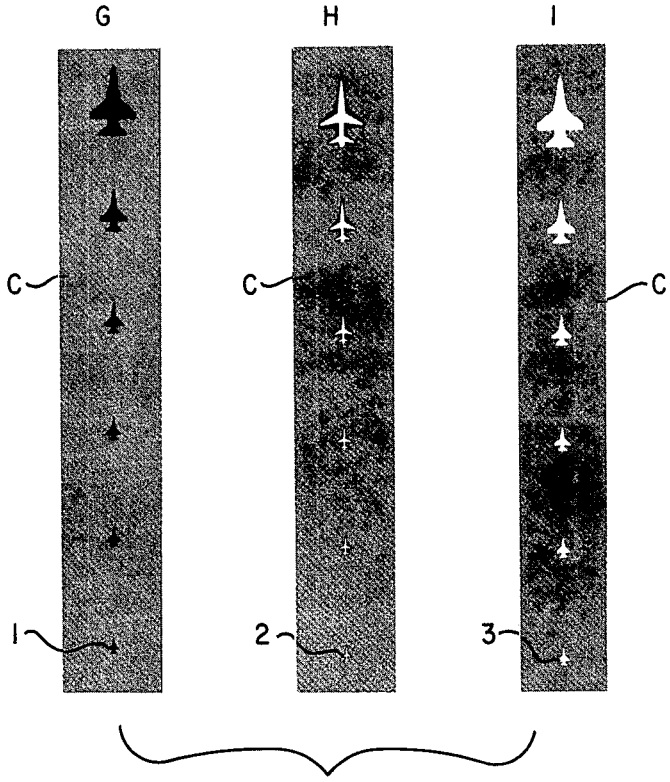
FIG. 3

FIG 4
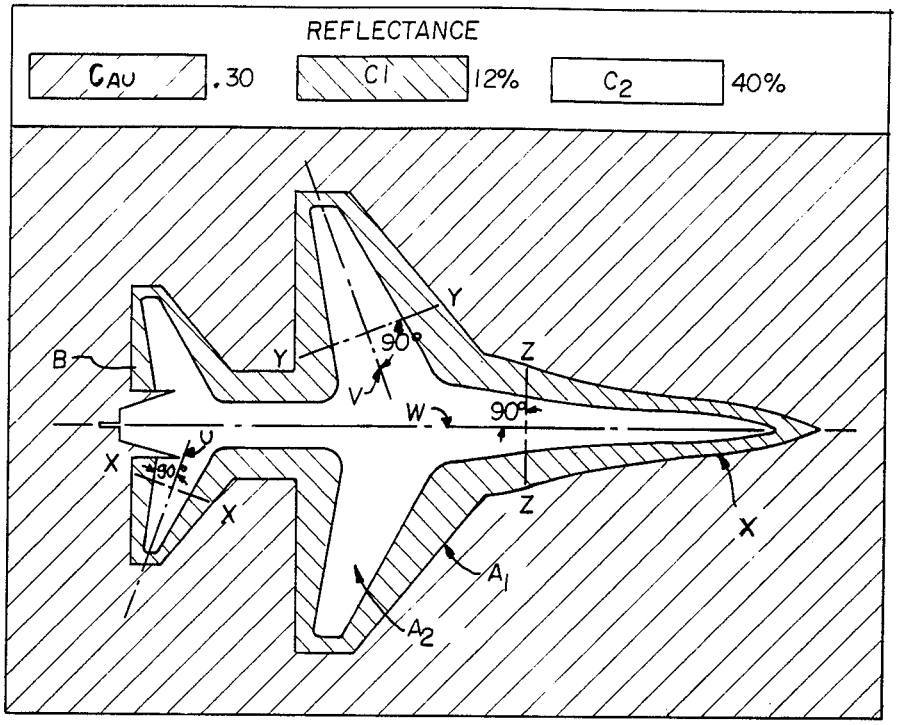
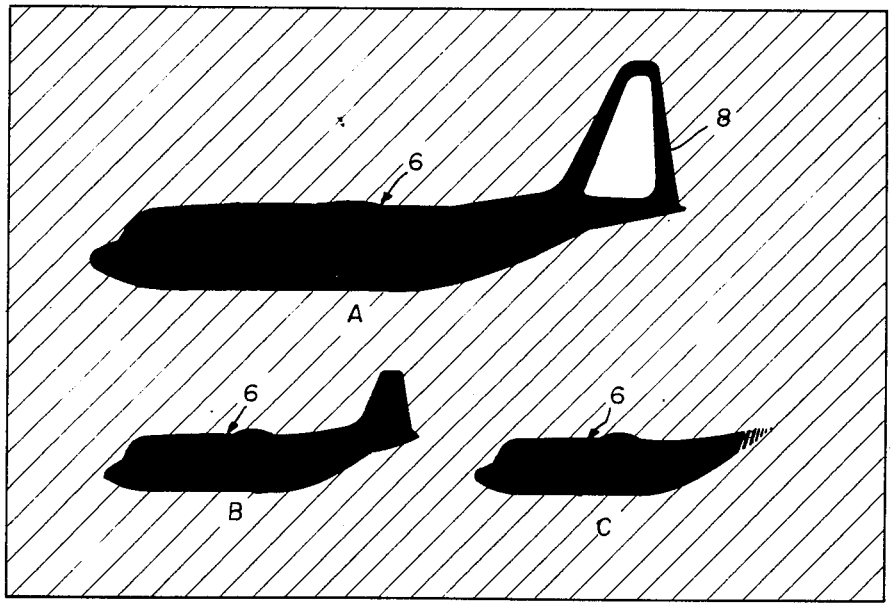
FIG 5

FIG 6
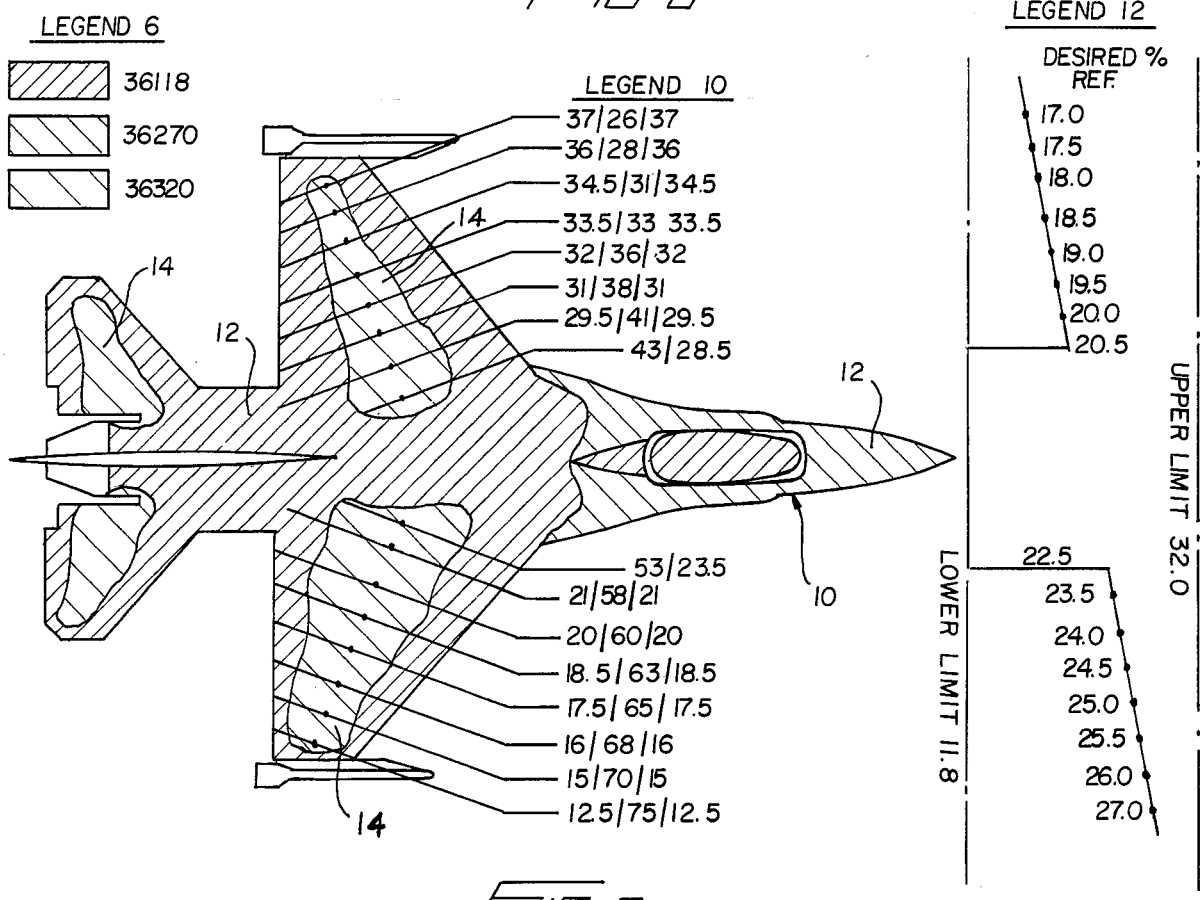
FIG 9
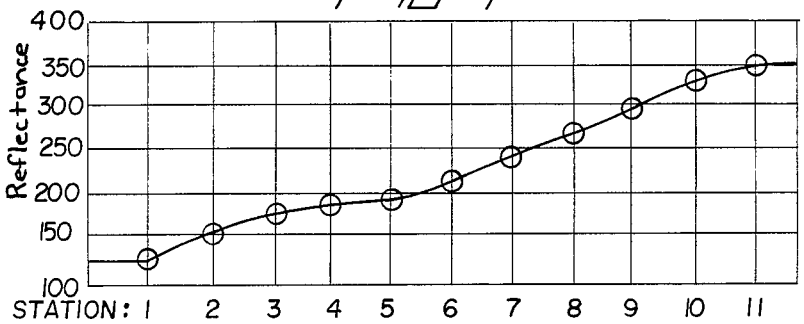
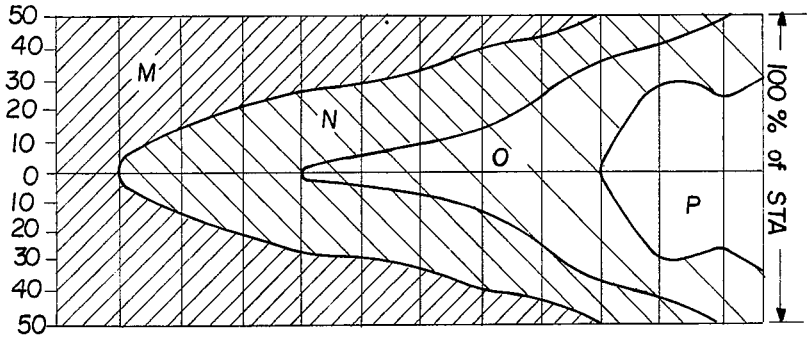
FIG 9A

CAMOUFLAGED VEHICLE SUCH AS AN AIRCRAFT, SURFACE VESSEL OR THE LIKE

FIELD OF INVENTION

This invention relates to aircraft surface vessels or wheeled vehicles or the like having camouflaged or deceptive coatings thereon for the purpose of hiding or confusing the enemy.

HISTORICAL BACKGROUND

The use of camouflage and deception for combat use on vehicles is shown in my earlier U.S. Pat. Nos. 4,089,491 and 4,212,440 for example.

Mackay U.S. Pat. Nos. 1,305,296 and Brush 715,013 are typical early developments in the area of camouflage. Mackay is directed to multicolored patterns which match surface backgrounds and Brush relates to countershading, or the employment of darker colors on top of a vehicle and lighter colors on the lower surface to kill the contrast between light and shade.

More recently, Barclay U.S. Pat. Nos. 2,190,691 and Robson 2,292,848 disclose various techniques for camouflaging vehicles for the purpose of confusing the enemy as to actual size and shape of a moving body. In general, my two patents above mentioned, show techniques for camouflaging aircraft to reduce the optical signature through counter shading as well as combining patterns designed to offer false visual cues to the enemy as to the vehicles' attitude, and the relationship of upper and lower surfaces as well as recognition of specific type and range.

Todays camouflage is directed primarily toward concealment, either against surface backgrounds such as the green-brown schemes of the 1960s and 1970s, the Asia Minor/desert schemes and the darker gray/green schemes currently in use in Europe, or in more recent developments, aircraft specialized for aerial combat are counter shaded to reduce internal contrast and total average reflectance is selected to match the sky, generally near the horizon, or distant haze or cloud. All current schemes are directed to reducing the optical signature contrast against officially selected backgrounds most likely to be seen during combat. Paints which reduce both radar and infrared signatures are also in use. This invention is designed to cover signatures in all of the light spectrum whether visible or invisible.

Vehicles painted to match selected backgrounds are generally successful and effective when operating in their intended environment. Since high speed vehicles such as aircraft cover large areas in short periods of time, the background against which they fly changes in reflectivity over substantial ranges of values.

An aircraft cannot be expected to match a single selected reflectance background at all times. The fact is that symmetrical single reflectance averaging often does not match the background. If it does not, then it is seen in its entirety as a clearly defined shape in complete contrast to the background and is easily recognizable as to type, attitude and range.

My earlier patents, including those referred to above, were designed to take advantage of varying backgrounds by offering some concealment for at least a portion of the aircraft if not all. This system is designed to deceive and to make it difficult to interpret the nature of the object which is seen. In general, only a portion of the object would be visible against any selected background and that portion will vary, depending upon which background it is seen against. Thus it is that an enemy will have considerable difficulty in determining the type of vehicle if he sees only a portion thereof. Similarly, confusion can be brought about in a nonvisible spectrum by proper treatment of the exposed surfaces. The exposed surfaces can be effective both in the visible spectrum as well as the non-visible spectrum so that the eye can be deceived as well as can electronic equipment.

OBJECTS AND SUMMARY

It is an object of this invention to provide a camouflage scheme designed to confuse the enemy as to the estimate of range and speed of a friendly vehicle.

Yet another object of this invention is to provide a camouflage scheme which will disguise the attitude, aspect and the actual direction of the vehicle.

A further object of this invention is to provide a camouflage scheme which will delay recognition of the vehicle by disrupting visual clues.

A still further object of this invention is to provide a camouflage scheme which will prompt indecision and induce mistakes on the part of an enemy.

Still another object of this invention is to provide a camouflage scheme which is directed towards concealment as well as towards confusion.

More specifically an object of this invention is to provide a camouflage scheme which causes the eyes to lose sight of true lines of demarcation.

Still a further object of this invention is to provide a camouflage scheme which more readily permits alteration in the field and easy change of patterns to meet different requirements such as those faced by rapid deployment forces or seabased units or the like.

A further object of this invention is to provide a camouflage scheme which will cause certain portions of the vehicle to remain undetected until much closer to the observer than here-to-for achievable.

Another object of this invention is to provide à camouflage scheme for vehicles in which the ojbect camouflaged will not be detected beyond the range at which it subtends a visual angle of five minutes of arc.

In summary therefore, this invention is directed to a camouflage system which can be readily adapted to all types of objects, surface and air vehicles, and is designed to reduce visual acquisition ranges and confuse the enemy. It may be easily modified to meet different operational environments and missions.

In the accompanying drawings which illustrate by way of example various embodiments of this invention:

FIG. 1 is a schematic plan view showing the relationship of the theoretical detection and identification ranges of an aircraft subtending two different visual angles.

FIG. 2 is a schematic plan view showing the effect on theoretical detection range of averaging the brightness of a black and white aircraft to equal a gray background.

FIG. 3 is a schematic showing three different aircraft together in different stages of proximity to the observer to graphically illustrate the effect of the averaging pattern on visual acuity.

FIG. 4 is a schematic showing an aircraft whose average reflectance has been adjusted mathematically.

FIG. 5 is a schematic showing the effect on detection and recognition range of averaging the reflectance of an aircraft component.

FIG. 6 is a schematic showing the plotting of a shift in reflectances across aircraft wings and horizontal stabilizers in a single color modification to an existing paint scheme.

Figure 8:
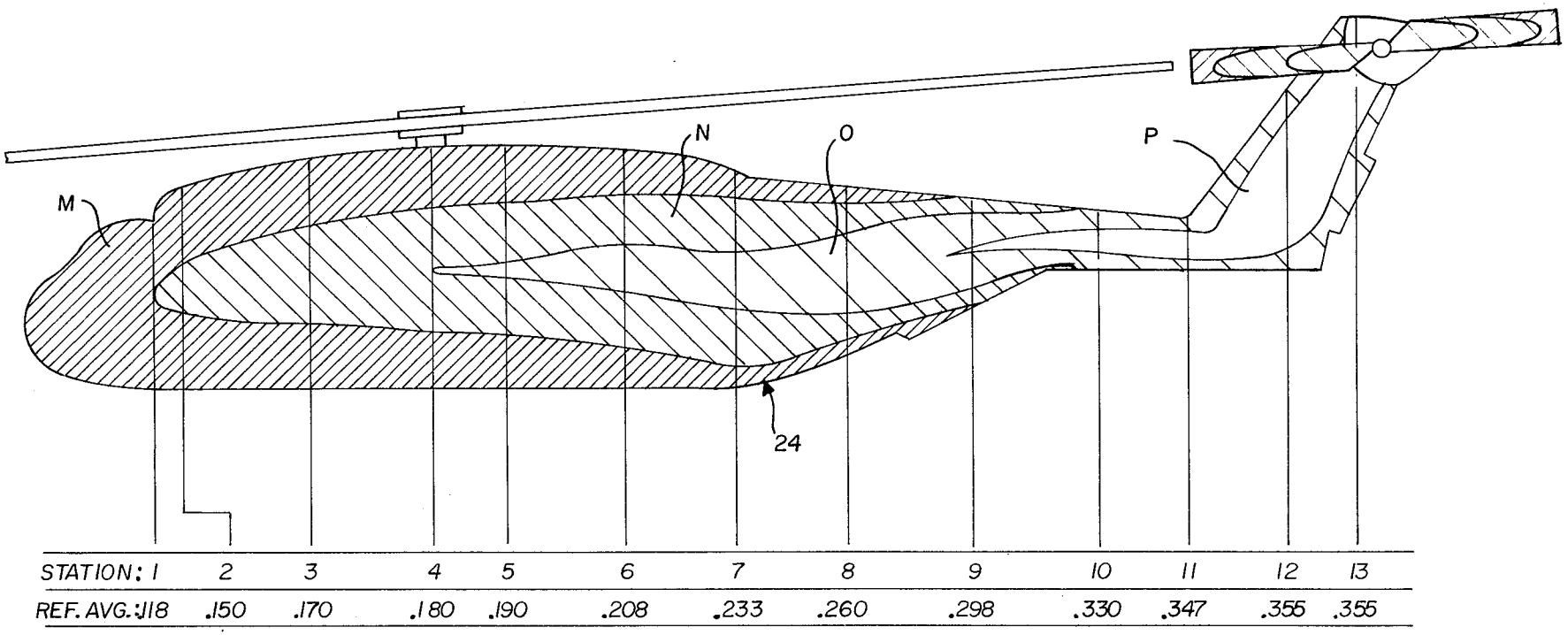
FIG. 8 is a schematic showing the plotting of a continuous shift of reflectances on a helicopter, using multiple colors in an averaging pattern.

FIGS. 9 and 9A graphs of selected reflectances and how these plot as percentages of stations on a rectangular object, such as the helicopter shown in FIG. 8 including both top and bottom surfaces.

FIGS. 1 and 2

In FIG. 1, the observer is shown by an eye E. A solid black aircraft is shown subtending 1 minute of arc at A, and 5 minutes of arc at B. C represents a solid white background against which the black aircraft is seen.

It is generally accepted that there are two visual thresholds for any given target. One of these is the point at which the target is first detected. The second is the much closer point at which the target will be recognized and identified.

The definition of 20/20 visual acuity is the ability of the observer to detect a black object on a white background when the object subtends a visual angle of one minute of arc and the ability to recognize and identify the object when it subtends a visual angle of five minutes of arc.

An observer having 20/20 visual acuity then would be able to see the black aircraft as a dot against the white background at distance A in FIG. 1 and able to recognize and identify the aircraft at distance B.

It will be noted that at distance B, the range at which the observer is able to recognize and identify the aircraft, is 1/5 the range at which the aircraft will be detected as a dot.

In FIG. 2 the observer is also shown by an eye E. The aircraft at position D incorporates the system of this invention and is seen against a gray background, G. The aircraft at D subtends 5 minutes of arc and at that distance is both visible and identifiable, just as the aircraft at B in FIG. 1. However, beyond 5 minutes of arc the aircraft at F is totally invisible, unlike the aircraft at A in FIG. 1. This represents a decrease in detection range to 1/5 that of the solid black aircraft at A, against a white background in FIG. 1. In FIGS. 1 and 2 a grid is depicted over the aircraft to indicate the increasing width of the arc and the distances on a comparative basis of 1 to 5.

The reason for this improvement is that the proportions of the black outline and the white inner area shown on the aircraft at D have been adjusted so that the reflectance of the black and white area add linearly to equal the reflectance of the gray background G. It should be noted that hue and saturation may be averaged as well as reflectance. The human eye averages values of stimuli of individual portions of any object to a single value when it subtends a visual angle of less than 5 minutes of arc. This means that an object or portion of an object can be painted in a pattern with two or more contrasting coatings, the total area of which, when viewed at a distance beyond which the area subtends 5 minutes of arc, will average to match a desired reflectance and hue different from that in the individual components at close range.

FIG. 3

FIG. 3 is a schematic showing a solid black aircraft 1, an aircraft 2 incorporating this invention, and a solid white aircraft 3. All are shown against an identical gray background C represented by the stipple effect. The aircraft 1, 2 and 3 are shown in a series of equal positions at increasing ranges from the observer. The three aircraft 1, 2 and 3 at the top would be closest to the observer and the three aircraft 1, 2 and 3 at the bottom would be the furthest from the observer.

It will be readily recognized by simultaneously eyeballing all three columns G, H and I of aircraft, that the aircraft in Column H, embodying this invention, becomes increasingly more difficult to see and identify than the black aircraft in Column G, or the white aircraft in Column I, as all three become smaller at a greater range. The effect of averaging black and white segments to add linearly to match the gray stipple background C in this schematic, is even greater when a solid gray is used in demonstration of the system of this invention. Holding FIG. 3 at 30 feet from the observer will readily demonstrate the contrasts between the aircraft 1, 2 and 3.

FIGS. 4 and 5

FIG. 4 discloses an aircraft 4 in plan view having defined portions $A_1$ and $A_2$, on which any segment X, Y or Z of the aircraft 4 includes at least three defined cooperative portions, at least two of which ($A_1$ and $A_2$) have different reflectances, so that when the reflectance of one defined portion is added to the reflectances of the others of the at least three defined portions and the result averaged, the total of the portions will have a reflectance substantially that of the predetermined light background C.

The total diffuse reflectance of the visible surface of an object may be determined by multiplying the area of each component coating by its reflectance value and dividing the sum of their products by the total visible area. The formula for this would be as follows:

$$C_{av} = \frac{A_1 \times C_1 + A_2 \times C_2 + A_3 \times C_3 \text{ (etc.)}}{A_1 + A_2 + A_3 \text{ (etc.)}}$$

$C_{av}$=Average Reflectance
$C_1$=Reflectance of Color of Area 1
$C_2$=Reflectance of Color of Area 2
$C_3$=Reflectance of Color of Area 3 (etc.)
$A_1$=Area of Area 1
$A_2$=Area of Area 2
$A_3$=Area of Area 3 (etc.)

If a specific average reflectance ($C_{av}$) is selected, and two contrasting coatings ($C_1$ and $C_2$) of greater and lesser reflectance values than $C_{av}$ are selected, then the percentage of the total area to be painted in $C_1$ and $C_2$ may be determined by use of this formula:

$$\frac{100(C_{av} - C_1)}{C_2 - C_1} = \frac{A_2}{100}$$

For example, if the average reflectance, $C_{av}$, selected for the aircraft in FIG. 4, is 0.30 and the values for the two coatings are $C_1$, 0.12 and $C_2$, 0.40, the percentage of the total area represented by $A_1$, coatings applied would render a substantial portion of the helicopter 24 invisible when observed against all background reflectances ranging from 12% to 37%. This represents a background reflectance spread of 25%. The degree to which non-matching helicopter components will be visible depends upon their individual contrast with the background and the range at which the total area of these components subtend 1 minute of arc. In practice the multiple reflectance aspect of this invention represents a substantial improvement over symmetrical single reflectance camouflage designed to match a single background, or any camouflage scheme which will average to a single reflectance across its entire area.

FIG. 9 shows substantially the same sequence of increasing average reflectance values as those selected for the helicopter in FIG. 8, with those values plotted for 11 stations or segments. The rectangular area of FIG. 9*a* below the graphic plot of FIG. 9 shows these values plotted as a percentage of segment at each station to be coated in colors M, N, O and P, to achieve the selected shift in average reflectance across the rectangular area.

This system then, may be used on any shape, from any aspect selected, to achieve desired average reflectances, hues, and saturations different from those of the component coatings, when the whole or parts are viewed at ranges beyond 5 minutes of arc.

On rotating objects, such as propellors or rotor blades, the component averages to a selected reflectance without the necessity for increasing range.

While this invention has been described as having a preferred design, it is understood that it is capable of further modifications, uses and/or adaptations of the invention following in general the principle of the invention and including such departures from the present disclosure as come within known or customary practice in the art to which the invention pertains, and as may be applied to the central features herein before set forth, and fall within the scope of the invention of the limits of the appended claims.

Having thus described my invention what I claim is:

1. A camouflage and deceptive perception distorted vehicle for combat use at least a substantial portion of which will remain undetected until the vehicle subtends an arc of substantially five minutes when used against at least one predetermined light background reflectivity, hue and saturation comprising:

(a) top, bottom, upper and lower side surfaces (b) at least one of said surfaces having at least one substantial edge outlined area (c) said edge outlined area having a predetermined reflectance, hue and saturation less than said at least one predetermined background reflectivity, hue and saturation (d) said edge outlined area including a substantial central portion having substantial width (e) said edge outlined area including a substantial edge outline portion having substantial width and having sections extending a substantial distance along opposite sides of said substantial central portion (f) said substantial central portion and said substantial edge outline portion having differing reflectances (g) said substantial central portion's reflectance being substantially greater than the reflectances of any of said substantial edge outline sections extending along opposite sides of said substantial central portion (h) the total reflectance, hue and saturation of said substantial central portion, when added to the sum of the total reflectance, hue and saturations of said edge outline sections extending along opposite sides of said substantial central portion, substantially averaging to said at least one predetermined light background reflectivity, hue and saturation (i) whereby, when said vehicle is used against said predetermined background, said substantial edge outlined area on at least said one of said surfaces, will substantially match said background and blend said area into said background preventing detection of said area.

2. A vehicle as in claim 1 and wherein:

(a) a plurality of said surfaces each include at least one of said substantial edge outlined areas.

3. A vehicle as in claim 2 and wherein:

(a) each of said edge outlined surfaces average to different predetermined light background reflectivity, hue and saturation.

4. A vehicle as in claim 2 and wherein:

(a) said substantial areas are equal and uniform and spaced equidistant on said at least one of said surfaces.

5. A vehicle as in claim 2 and wherein:

(a) said substantial areas are equal and uniform and mirror images of each other and sapced equidistant on said at least one of said surfaces.

6. A vehicle as in claim 2 and wherein:

(a) said areas are generally trapezoidal in configuration, and (b) said trapezoid configurations run parallel to each other.

7. A vehicle as in claim 6 and wherein:

(a) said trapezoidal configurations are diagonally disposed relative to the longitudinal axis of said vehicle.

8. A vehicle as in claim 1 and wherein:

(a) said edge outline portion encompasses at least 50% of said substantial central portion.

9. A vehicle as in claim 1 and wherein:

(a) said edge outline portion encompasses the entire substantial central portion.

10. A vehicle as in claim 1 and wherein:

(a) said edge outline sections are irregular in width.

11. A vehicle as in claim 1 and wherein:

(a) said substantial central portion and said edge outline sections are colored and the color of said substantial central portion and said edge outline sections average to substantially the color of said predetermined light background.

12. A vehicle as in claim 1 and wherein:

(a) said average reflectance, hue or saturation of said at least one area is the formula $$C_{av} = \frac{A_1 \times C_1 + A_2 \times C_2 + A_3 \times C_3 \text{ (etc.)}}{A_1 + A_2 + A_3 \text{ (etc.)}}$$

where $C_{av}$=Average reflectance, hue or saturation $C_1$=Reflectance, hue or saturation of portion $A_1$ $C_2$=Reflectance, hue or saturation of portion $A_3$, (etc.)

$A_1$=Area of portion $A_1$ $A_2$=Area of portion $A_2$ which will be coated in reflectance $C_1$, is 36% and the remaining area represented by $A_2$, which will be coated in reflectance $C_2$, is 63%. It will be noted that random segments X—X and Y—Y, which lie perpendicular to the 50% chord lines U and V, of the horizontal stabilizer and wing, and segment Z—Z, which lies perpendicular to the aircraft center line W, are composed of three portions. The two outer portions are equal to 18% of the segment, each is half of the percentage comprising $A_1$ and the single inner portion comprising $A_2$, represents 64% of the total segment.

An actual aircraft painted in the exact pattern shown in FIG. 4, using coatings of 12% reflectance on the outer portion A and 40% on the inner portion $A_2$, when observed at a range at which its total area subtends less than 5 minutes of arc, will be averaged by the eye of the observer to a reflectance of 30%. If the background reflectance is 30%, the aircraft whose average reflectance is 30% will substantially match its background, thus remaining invisible beyond the range at which its total area subtends 5 minutes of arc.

FIG. 5 shows a large aircraft 6 with slightly over 500 square foot of vertical stabilizer 8. The vertical stabilizer 8 is the major contributor to early visual acquisition and recognition of a large dark painted aircraft when seen in side profile. Under good lighting conditions and good background contrast, this appendage 8 would be visible at a range of approximately 15 miles as seen in the aircraft 6 on the lower left side of FIG. 5. Proper application of this invention to this single component 8 of the aircraft 6 reduces its detection threshold or acquisition range from 15 miles, where it subtends 1 minute of arc, to 3 miles, where it subtends 5 minutes of arc as seen on the lower right side of FIG. 5.

Figure 7:
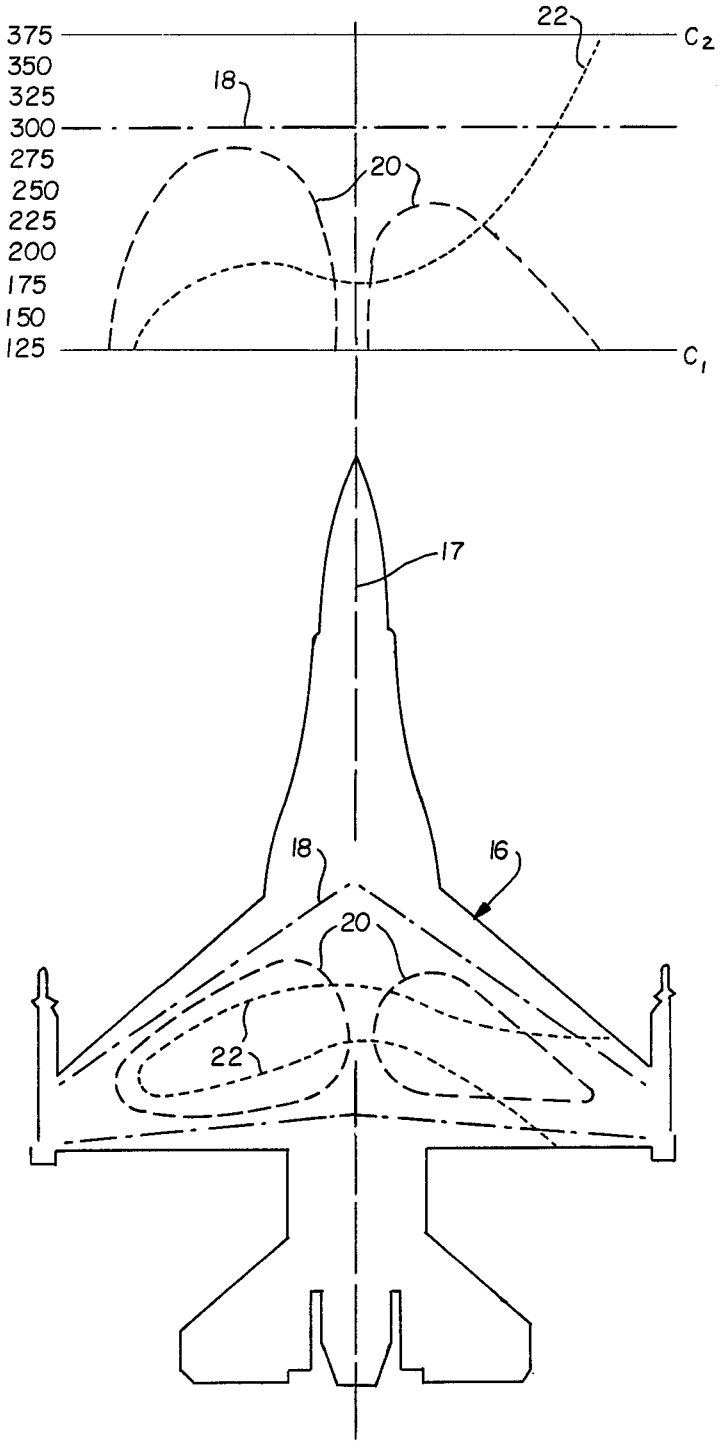
FIG. 7 is a schematic showing graphically a few of the unlimited choices of patterns possible, with an outline of the aircraft below and typical reflectance values presented on the graph above the aircraft in spaced relation thereto as shown along the vertical center line.

FIGS. 6 and 7

FIG. 6 shows an aircraft 10 with the paint scheme of this invention applied in a carefully controlled modification of dark areas 12 and light areas 14 for the purpose of increasing the overall reflectance of the darker area 12 while introducing a 10% shift in average reflectance across the aircraft wings and horizontal stabilizer.

The color legend 6 to the left of the drawing shows the two designated colors in which the aircraft is coated, 36118 and 36270, plus a third color, 36320, introduced, using the principles of this invention, to achieve the increase and shift in average reflectance. Colors are expressed in Federal Standard 595a numbers in which the last three digits represent the approximate diffuse reflectance value of each color. Without the introduction of the areas painted in color 36320 the average reflectance of the wings and stabilizers would be a uniform 11.8%.

LEGEND 12 shows a selection of desired average reflectances for each corresponding segment across the aircraft wings. It will be noted that these average reflectances begin with 17% on the left outer wing and increase in equal increments across the wings to a 27% average reflectance on the right outer wing.

Applying the formula referred to in FIG. 4 and using the values for each segment shown in Legend 12 as the average desired reflectance, $C_{av}$, and the values for the darkest paint, 38118 (11.8% reflectance), as $C_1$, and the modifying color, 36320 (32% reflectance) as $C_2$, thus the percentages of each segment to be painted in the two colors may be determined and are shown in Legend 10. For example, it will be seen that in order to achieve an average reflectance of 17% on the left outer wing, the sequence of paint on that segment would be 37% of the chord painted in 36118 on the trailing edge, 26% painted in 36320 in the center and 37% painted in 36118 on the leading edge of the wing.

It should be obvious that so long as the desired reflectances, as shown in Legend 12, fall between the lower limit of the selected color reflectance, in this case 11.8%, and the upper limit selected, in this case 32%, many different effects can be achieved simply by selection of desired reflectances across the aircraft. This in turn will drive the proportions of paints to be applied at each segment and determine the final pattern to precisely achieve the desired results.

FIG. 7 shows an aircraft 16 with a center line 17 extending with the related reflectance graph above, on which is plotted a straight dot and dash coded line labeled 18, at the 30% reflectance level. Also plotted are curves 20, coded with a dashed line, and curve 22, coded with a dotted line. Curves 20 and 22 represent variations in average reflectance for two patterns across the wings of the aircraft.

The effect upon the shapes of patterns may be seen by comparing the coded plot for line 18 and curves 20 and 22 with their counterparts on the aircraft 16, as each is driven by the selected average reflectance for any station or segment across the aircraft 16.

It is obvious that varying the selection of the coatings, which establish the upper and lower limiting reflectances, as well as varying the desired reflectances for each segment, as necessary to achieve the specific objectives of a paint scheme, will greatly affect the appearance of resulting patterns. The exact pattern, in each case, will become apparent only after the proportion of each coating making up each segment is determined mathematically by use of the formula in the references to FIG. 4.

It can be seen that the maximum theoretical shift in reflectance available would be 100%. This would occur with the selection of white as the upper limit, with a theoretical reflectance of 100%, and the selection of black as the lower limit, with a theoretical reflectance of zero %. While these reflectances are not achieved in reality, a 100% spread would in any case be undesireable in practice.

The maximum desireable reflectance shift would be approximately 30%, with the lower limit placed at approximately 10% reflectance, and the upper limit no higher than approximately 40% reflectance, while the most practical limits will probably fall between 12% and 37%, or a shift of 25% in average reflectance.

FIGS. 8, 9 and 9*a*

FIG. 8 shows a helicopter 24 in which coatings of four different reflectances, hues or colors are used. The lower reflectance limiting value, coating M, is 0.118, and the upper reflectance limiting value, coating P, is 0.375, with the values for the two intermediate coatings, N and O, falling more or less evenly between the values of M and P. The proportions of the darkest color, M, relative to each of the lighter colors, N, O and P, as each is introduced in order, from left to right, has been mathematically adjusted to achieve a substantially even progression of increasing average reflectances for each segment, beginning at Station 1, where the average reflectance is that of color M, 0.118, to Station 13 where the proportions of coatings O and P have been averaged to achieve a reflectance of 0.355. Thus, in this case, the $A_3$=Area of portion $A_3$ (etc).

13. A vehicle as in claim 1 and wherein:

(a) said at least one of said surfaces includes a second substantial area having a total predetermined reflectance, hue or saturation substantially matching a second predetermined light background reflectivity, hue or saturation, and (b) at least said one and said second substantial areas provides a gradual shift in predetermined area reflectances, hues or saturations from said at least one substantial area to said second substantial area.

14. A vehicle as in claim 13 and wherein:

(a) said total predetermined reflectances of each of said substantial areas do not shift more than about 30% from said at least one substantial area to said second substantial area.

15. A vehicle as in claim 1 and wherein:

(a) at least top, and upper and lower side surfaces each include at least one substantial area having a predetermined reflectance, hue or saturation substantially matching said at least one of said predetermined light background reflectivities, hues or saturations.

16. A vehicle as in claim 1 and wherein:

(a) said top, bottom, upper and lower side surfaces each include at least one substantial area having a predetermined reflectance, hue or saturation substantially matching said at least one of said predetermined light background reflectivities, hues or saturations.

17. A vehicle as in claim 1 and wherein:

(a) said predetermined light reflectances, hues or saturations are in the visible spectrum.

18. A vehicle as in claim 1 and wherein:

(a) said predetermined light reflectances, hues or saturations are in the non-visible spectrum.

19. A vehicle as in claim 1 and wherein:

(a) said predetermined reflectances, hues or saturations are in the visible and non-visible spectrum.

* * * * *